US005350150A

United States Patent [19]

Fiore

[11] Patent Number: 5,350,150

[45] Date of Patent: Sep. 27, 1994

[54] WALL MOUNTING BRACKET FOR CARRYING CASE

[75] Inventor: Joseph F. Fiore, Lebanon, Pa.

[73] Assignee: Doskocil Manufacturing Company, Inc., Arlington, Tex.

[21] Appl. No.: 956,156

[22] Filed: Oct. 5, 1992

[51] Int. Cl.[5] ..... A45C 13/18

[52] U.S. Cl. ..... 248/552; 70/62; 70/63; 248/221.4; 248/305

[58] Field of Search ..... 248/221.4, 552, 305, 248/309.1, 914; 70/62, 63; 190/101, 120, 121, 23

[56] References Cited

U.S. PATENT DOCUMENTS

| | | | |
|---|---|---|---|
| 1,454,546 | 5/1923 | Landis | 190/101 X |
| 1,511,539 | 10/1924 | Suarez | 248/552 X |
| 1,796,502 | 3/1931 | Boucher | 109/52 |
| 3,659,442 | 5/1972 | Cellini et al. | 70/63 |
| 4,119,199 | 10/1978 | Whitaker, Jr. | 206/317 |
| 4,312,455 | 1/1982 | Weber | 248/914 X |
| 4,444,031 | 4/1991 | Watson | 70/232 |
| 4,788,838 | 12/1988 | Cislo | 70/63 |
| 4,890,466 | 1/1990 | Cislo | 70/62 |
| 4,951,577 | 8/1990 | Bentley | 70/63 X |
| 5,009,088 | 4/1991 | Cislo | 70/63 |

*Primary Examiner*—Richard K. Seidel
*Assistant Examiner*—Kenneth E. Peterson
*Attorney, Agent, or Firm*—Andrew J. Dillon

[57] ABSTRACT

A wall mounting bracket is provided for a carrying case such as a gun case, a camera case or a jewelry case. The handle of the case fits onto the bracket and can be locked in place by a padlock. The padlock also prevents the case from being opened when fitted on the bracket.

4 Claims, 2 Drawing Sheets

WALL MOUNTING BRACKET FOR CARRYING CASE

SUMMARY OF THE INVENTION

This invention relates to a wall mounting bracket for a carrying case, such as a gun case, a camera case, a jewelry case, or the like, which enables the case to be securely attached and locked in place on the bracket while also preventing the case from being opened when locked.

It is desirable with carrying cases of the above types to have a facility, for security purposes, whereby the case can be safely locked away to prevent both access to the interior of the case and also theft of the entire case itself. The invention provides such a facility.

According to the invention, a wall mounting bracket is provided for a carrying case which has hinged base and lid sections with parts of the respective sections fitting together when the case is closed to form a handle. The mounting bracket has a flange whereby it can be fastened to a wall or other mounting surface, and a support member extending outwardly from the flange to receive the handle of the closed case. Aligned apertures are formed through each part of the case which defines the handle and through the support member to receive the hasp of a padlock when the case is mounted on the support member. With the padlock in place, the case cannot be removed from the mounting bracket and the two parts of the handle cannot be separated sufficiently to open the case.

Additional features and advantages of the invention will be apparent from the ensuing description and claims read in conjunction with the attached drawings.

DESCRIPTION OF PREFERRED EMBODIMENTS

Figure 1:
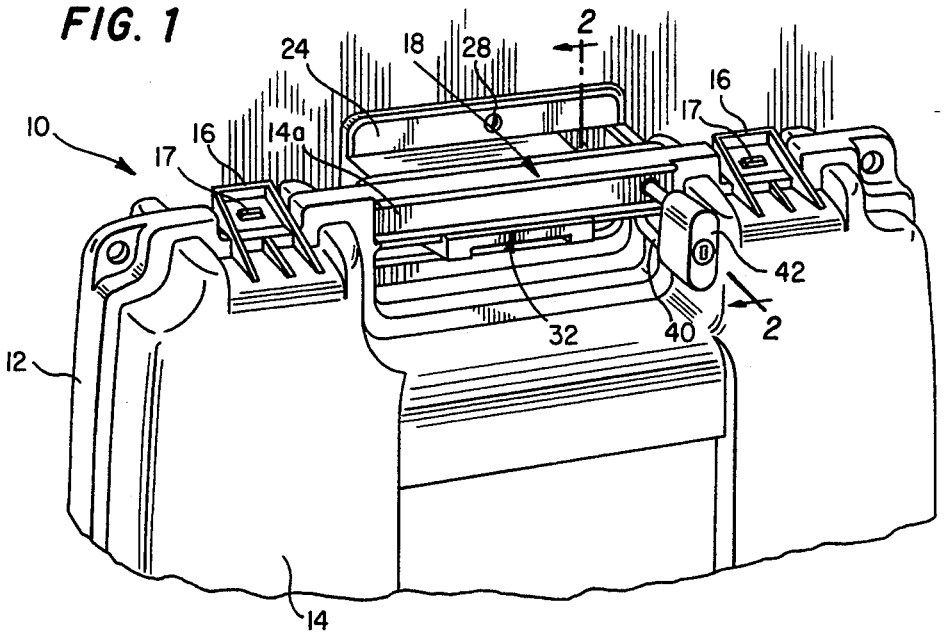
FIG. 1 is a perspective view of part of a first embodiment carrying case and wall mounting bracket according to the invention.

In the drawings, like reference numerals are used to denote like parts of the respective embodiments.

Figure 2:
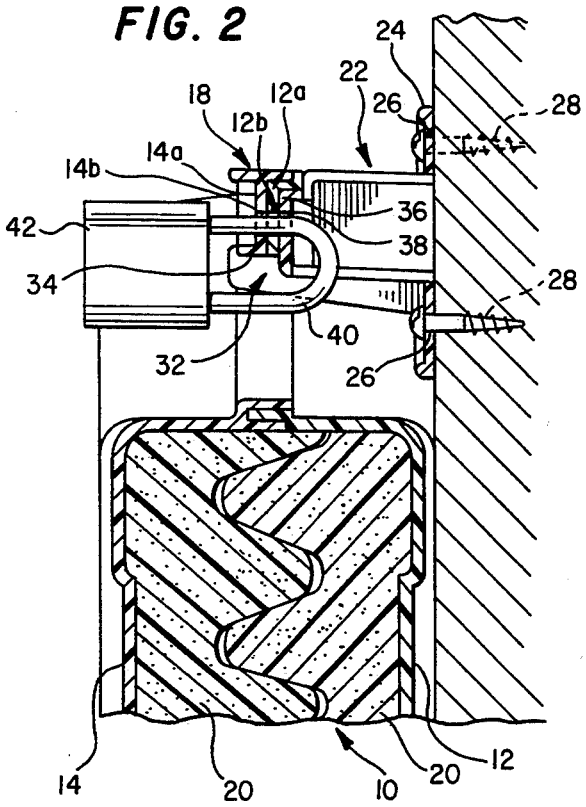
FIG. 2 is a sectional view on line 2—2 of FIG. 1.
Figure 3:
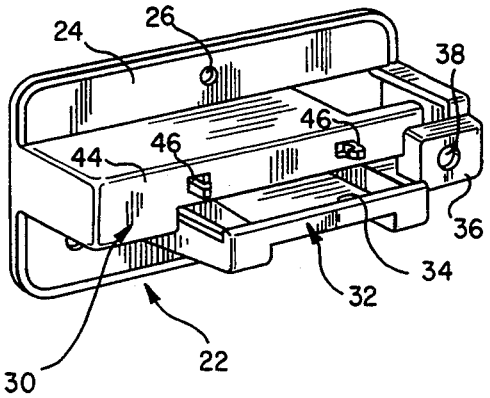
FIG. 3 is a perspective view of the first embodiment mounting bracket.
Figure 4:
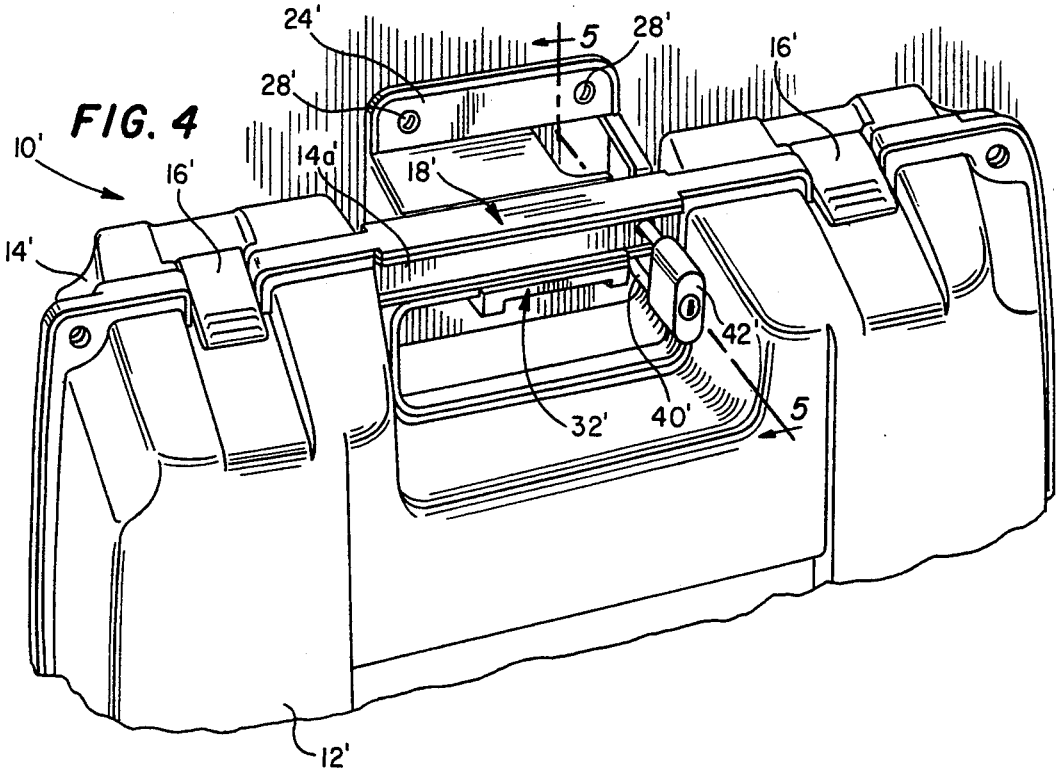
FIG. 4 is a view similar to FIG. 1 of a second embodiment carrying case and mounting bracket.
Figure 5:
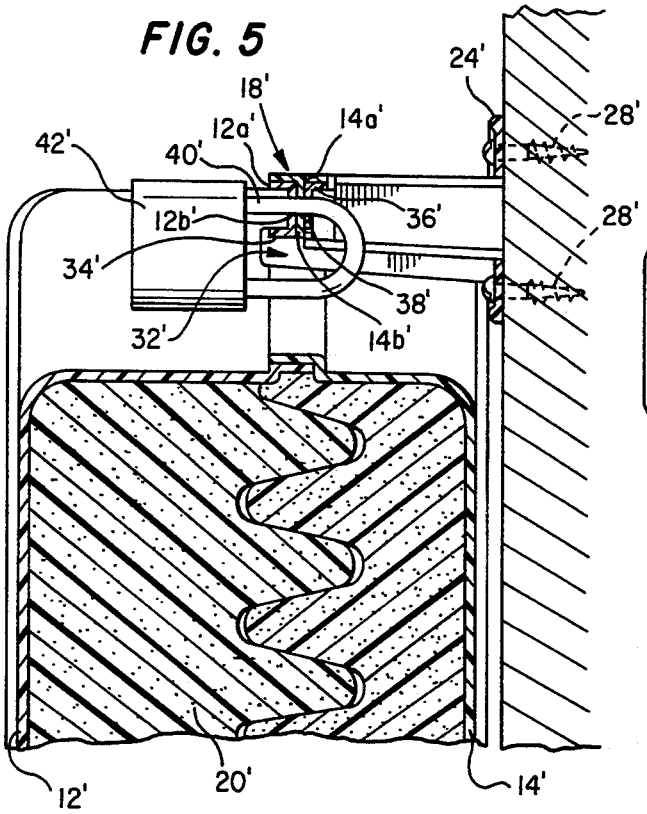
FIG. 5 is a sectional view on line 5—5 of FIG. 4.
Figure 6:
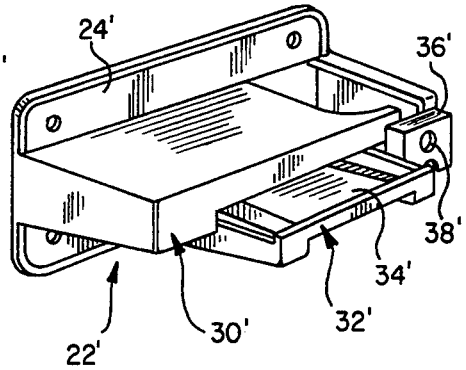
FIG. 6 is a perspective view of the second embodiment mounting bracket.

Referring firstly to FIGS. 1 to 3, a gun case 10 for small pistols and the like has a plastic molded base 12 and a hinged plastic molded lid 14 with molded latches 16 on the lid which engage corresponding catches 17 on the base, to close the case in known manner. The base and lid sections of the case have respective portions 12*a* and 14*a* which fit together when the case is closed, see FIG. 2, together to form a carrying handle 18 of the case. The case may include conventional foam inserts 20.

To mount and lock case 10 on a wall or the like, there is provided a plastic molded bracket 22 with a flange 24 having openings 26 for wall or like fasteners, such as screws 28. Extending from flange 24 is a support member 30 including a base element 32 on which the handle 18 of the case can be received to fit in a channel-like cradle 34 against an upright rear wall section 36. In the wall section 36 there is formed an aperture 38 and like apertures 12*b*, 14*b* are formed in the handle portions 12*a*, 14*a* of the case to align with aperture 38 when the case is fitted on the bracket. Behind the wall section 36, bracket 22 is open top and bottom to allow the hasp 40 of a suitably sized padlock 42 to be passed through the aligned apertures 38, and 12*a*, 14*a*. Thus, with the lock in place, the case as a whole cannot be removed from the bracket, and the handle portions 12*a*, 14*a* cannot be separated sufficiently to open the case.

In order temporarily to attach the bracket 22 to the case, for example for sales and marketing if the bracket cannot fit inside the case, a front wall 44 of support member 30 which fits against handle portion 12*a* may be formed with tabs 46 which snap fit into suitably located openings, not shown, in handle portion 12*a*. The tabs can be removed by the end user.

FIGS. 3 to 6 show a larger size gun case and mounting bracket which fit together and can be locked in the same manner as for the first embodiment structures. The sizes and proportions of the parts are somewhat different in the two embodiments and the second embodiment bracket 22' does not have tabs equivalent to the tabs 46, because in the second embodiment, the bracket 22' can fit in a compartment of case 10' for sales and marketing.

While only preferred embodiments of the invention have been described in detail, the invention is not limited thereby and modifications can be made within the scope of the attached claims.

I claim:

1. A carrying case and a wall mounting bracket for said case, the carrying case having a base, a lid, and respective apertures in pars of the base and lid which parts fit together when the case is closed to form a carrying handle of the case with said apertures in alignment, the mounting bracket having a flange for attaching same to a wall or other mounting surface, a support member extending from said flange to receive said carrying handle of the case thereon, said support member including a base member for receiving said carrying handle of the case thereon and an upright wall section adjacent said base member formed with a further aperture, the bracket being opened behind said wall section for receipt of a padlock hasp, said further aperture in said support member to align with said apertures of the case when said carrying handle is received on said support member in a manner whereby a hasp of a padlock can be passed through all of said apertures for locking the case to the bracket and preventing said parts of the base and lid of the case from being separated sufficiently to open the case.

2. The invention defined in claim 1, wherein the support member further includes an upright wall behind the base member.

3. The invention defined in claim 2 including removable tabs on said upright wall for snap fitting in corresponding openings in the handle to temporarily secure the bracket to the case prior to attaching the bracket to a wall or other surface.

4. The invention defined in claim 1, wherein the base member is channel shaped for cradling the handle thereon.

* * * * *